US005232168A

United States Patent [19]

Lybecker et al.

[11] Patent Number: 5,232,168

[45] Date of Patent: Aug. 3, 1993

[54] APPARATUS AND METHOD FOR SEPARATING RECYCLABLE MATERIAL FROM WASTE MATERIAL

[75] Inventors: G. Wayne Lybecker, Rochester; Timothy P. Sherrow, Waterford, both of Mich.

[73] Assignee: Engineered Systems, Inc., Fraser, Mich.

[21] Appl. No.: 859,658

[22] Filed: Mar. 30, 1992

[51] Int. Cl.[5] ..... B02C 13/286

[52] U.S. Cl. ..... 241/24; 241/32; 241/81; 241/186.3; 241/186.5; 241/DIG. 38; 209/662

[58] Field of Search ..... 241/24, 32, 81, 96, 241/186.3, 186.5, DIG. 38; 209/662, 628

[56] References Cited

U.S. PATENT DOCUMENTS

| | | | |
|---|---|---|---|
| 1,022,655 | 4/1912 | Brine | 209/662 |
| 2,424,171 | 7/1947 | Huddle | 241/81 |
| 3,703,970 | 11/1972 | Benson | 241/32 |
| 4,037,799 | 7/1977 | Urban | 241/186.5 |

FOREIGN PATENT DOCUMENTS

| | | | |
|---|---|---|---|
| 3705254 | 9/1988 | Fed. Rep. of Germany | 241/32 |
| 3734270 | 4/1989 | Fed. Rep. of Germany | 241/81 |
| 1057106 | 11/1983 | U.S.S.R. | 241/186.5 |

*Primary Examiner*—Mark Rosenbaum
*Assistant Examiner*—John M. Husar
*Attorney, Agent, or Firm*—Basile and Hanlon, P.C.

[57] ABSTRACT

A method and apparatus for separating recyclable material from waste material in a material handling system. The material separator comprises a screw conveyor that separates waste material from recyclable material. The screw feeder also feeds the recyclable material into a crusher for pulverization. The waste material bypasses the crusher and is deposited onto a screen for removal into a waste bin. The crusher generally pulverizes the material received by the screw conveyor. However, if uncrushable material is dropped into the crusher assembly, a ballistic part ejector is provided for use with the crusher. The crusher apparatus has a housing and a rotary crusher member. The housing of the crusher apparatus includes convergent walls along one portion to direct ballistic or thrown uncrushable debris in a predetermined direction toward an ejector aperture formed in the housing. A closure member operably obstructs the ejector aperture in the housing. A sensor member is used to sense ballistic or thrown debris within said housing. A motor or other power driven device, responsive to the sensor member, is used for opening the closure member for a predetermined period of time to allow egress of the ballistic or thrown uncrushable debris within the housing.

22 Claims, 6 Drawing Sheets

APPARATUS AND METHOD FOR SEPARATING RECYCLABLE MATERIAL FROM WASTE MATERIAL

FIELD OF THE INVENTION

The present invention relates to an apparatus and method for separating parts or material. More particularly, the present invention relates to a part or material separator having a screw feeder that separates the material while feeding the material into a material crusher and includes an apparatus for preventing serious damage to a crusher as a result of introducing debris too large to be crushed by the crusher.

BACKGROUND OF THE INVENTION

Material handling systems developed for separating usable or recyclable parts from waste material generally comprise a conveyor for transporting the material to be separated from a recycling bin into a material separator assembly.

Generally, the material separator assembly includes a screw feeder for receiving the material or parts from the conveyor. The screw feeder feeds the parts from the conveyor along a horizontal path towards a chute. The parts are guided by the chute downward to a screen. The screen acts as the separator of the recyclable material from the waste material. The screen is mechanically or electrically vibrated to shake apart the waste material from the recyclable material. Therefore, the size of the mesh forming the screen determines the size of the acceptable parts to be recycled.

The parts that fall through the mesh in the screen are led to a crusher to be broken up into smaller pieces for reprocessing. The waste material is removed, usually by hand, from the top of the vibrating screen to a dumping area.

Although the use of a vibrating screen is generally successful in preventing large pieces of metal or other unwanted parts from traveling into the crusher, there are several disadvantages. Generally, the material to be recycled comprises metal shavings found in cutting fluids and discarded metal blocks remaining after machining a part. The waste material is generally swept away into one large container. The metal shavings and blocks may tangle together to create a large mass, such as a ball of metal.

The vibrating screen may be capable of separating the metal chunks from the metal shavings contained in such a ball of metal, however, the vibration may not break up the tangled mass of shavings which ordinarily would fall through the screen mesh. Therefore, the use of a vibrating screen to separate such materials creates too much waste as it does not provide a system to break apart recyclable material adequately. Instead, what was once recyclable material becomes waste material that is removed from the screen and thrown away. This system creates a great waste in material and money.

The parts that fall through the screen to the crusher are generally broken up into smaller pieces for reprocessing. In prior known crushers, it was important to prevent the introduction of uncrushable material or debris which could cause serious damage to the crusher mechanism and housing. Therefore, elaborate means were employed, typically including numerous screen grates or other devices to prevent the ingress of uncrushable material larger than the screen aperture opening area used in the internal crushing chamber.

Typically, the crusher apparatus includes a housing enclosing a rotary crusher device having a cylindrical portion of a predetermined length approximately the same as the length of the housing, with rotatable hammer arms extending generally radially outwardly from the cylindrical portion of the rotary crusher means in response to centrifugal forces caused by the rotation of the cylindrical portion. The pivotal hammer arms or extensions are capable of rotating with respect to the cylindrical portion in order to absorb any excessive impact with debris which is difficult or impossible to crush. This pivotal function of the rotatable hammer arms or extensions protects the device from serious damage to a certain degree. However, when an uncrushable item is encountered, the pivotal hammers continuously impact with the uncrushable debris causing the debris to become ballistic due to the impact with the hammer arm, thereafter subjecting the housing to subsequent impacts from the ballistic part potentially causing damage to the housing. Extensive and continuous impact with the uncrushable object by the hammer arms could also lead to damage to the hammer arms preventing the proper pivoting of the arm, or in the worst case, causing the arm to be broken off or removed with respect to the rotary cylindrical crusher member.

The present invention seeks to alleviate the problems associated with the prior known crusher apparatus. In the past, elaborate and expensive screening equipment has been employed to prevent uncrushable debris or parts from entering the crushing chamber. This precaution has primarily been necessary in order to eliminate any uncrushable debris or parts from entering into the crushing chamber, since previously there has been only one exit from the crushing chamber, i.e., through the crushed debris grate assembly. Uncrushable debris in the crushing chamber has been a problem for an extended period of time causing extensive damage to the crushing mechanism and housing. It is desirable in the present invention to overcome these perceived disadvantages of the present designs of crusher apparatuses.

SUMMARY OF THE INVENTION

The present invention provides a method and apparatus for separating material which overcomes the disadvantages of the previously known material separators.

The material separator of the present invention uses the screw feeder to separate the recyclable material from the waste material while it is feeding the recyclable material to the crusher. This method of separating the material is advantageous in that it uses the feeder for two purposes.

The material separator of the present invention comprises a screw feeder or conveyor which receives material from a conveyor. The crew conveyor has a continuous screw section extending the length of the material separator. The screw conveyor feeds the material from the material handling conveyor along a horizontal axis into a chute. The chute guides the recyclable material downwardly towards the material crusher.

The material which is too large to be fed by the screw conveyor into the crusher continues along the horizontal path to the parts discharge chute. The chute bypasses the crusher and deposits the waster material directly onto a vibrating grid. The recyclable material is also deposited into a hopper after it has been processed through the crusher. The waste material is removed from the top of the vibrating grid into a waste material bin.

The screw conveyor is aided in separating the recyclable material from the waste material by a feeder plate which extends at an angle along the entire length of the screw conveyor. A guide plate extends at an angle above the screw conveyor at the point where the material is conveyed into the screw conveyor. As the material is conveyed into the separator, the guide plate forces all the material onto the top of the screw conveyor.

The screw conveyor rotates away from the feeder plate. An elongated slot is disposed between the screw conveyor and the feeder plate for deposit of the recyclable material into the crusher area. As the screw conveyor rotates away from the plate, the circular pitch of the screw determines the acceptable size of recyclable material to be fed through the crusher.

As the material is fed along the screw conveyor, the waste material that does not fit within the circular pitch of the screw, or the slot, travels atop the slot along the feeder plate. At the end of the screw conveyor, a retractable cone overhangs the screw conveyor and rests on the feeder plate. The cone is gravity hung by a support bracket and chains. The cone has a flexible base for resting on the feeder plate. As the material approaches the retractable cone, the lighter recyclable material will pass through the slot. The heavier material, such as a metal block, will force the cone to retract upwards allowing the screw conveyor to feed the waste material into the parts discharge bin.

The recyclable material passing through the slot, is fed by gravity into a rotary crusher that breaks the material apart and feeds it to a hopper. The waste material is discharged from the screw conveyor down a parts discharge chute onto a vibrating grid. The parts discharge bypasses the crusher thereby eliminating the possibility of damaging the crusher on parts that are too large to be broken apart by the crusher hammers. The waste material is deposited on the vibrating grid and is removed from the system, since it is too large to slip through the grid into the hopper.

In other words, all material entering the separator is directed into the valley formed between the screw feeder and the feeder plate. Material small enough to pass through the opening formed by the circular pitch of the screw on two sides and the screw center pipe and the feeder plate on the other two sides fall directly to the crusher. Bushy recyclable material and large solid material conveys in the valley toward the retractable cone. As the bushy material conveys into the cone, it is compressed into the flights of the screw. The screw rotation is away from the feeder plate and as the bushy material is compressed it becomes entrained in the circular pitches causing it to ride over the top of the screw and to fall into the crusher feed opening which is on the opposite side of the screw from the feeder plate. The large solid material continues to convey into the cone causing it to retract and allow the solid to pass into the discharge chute opening and fall onto the vibrating grid. Any small recyclable material which may come out with the solid passes through the grid openings into the hopper under the crusher.

Material entering the crusher area from the screw feeder is crushed by the rotation of the crusher hammers. The present invention addresses the disadvantages of previously known crushers by providing an alternative exit from the crusher enclosure or housing for ballistic parts which prove to be uncrushable after impact with the rotatable hammer arms.

In the disclosed embodiment of the present invention, the side walls of the crusher housing are disposed convergent towards one another with an aperture leading external of the enclosure adjacent the area of convergence. As an uncrushable part of debris is propelled in a ballistic manner by impact with the pivotal hammer arms, the side walls of the housing divert and funnel the ballistic part toward the aperture in the housing. To present escape of crushable material, the aperture is normally covered by at least one rotatable flap or door. The flap or door is normally in the closed position. Sensor means detect the presence of a ballistic part within the enclosure and cause the flap or door to be moved to the open position for a predetermined period of time to allow egress of the uncrushable debris from the enclosure through the open aperture.

In the preferred embodiment disclosed herein, the present invention employs sensor means to detect the position of the normally closed flap or door. The normally closed flap or door is supported by a hinged connection allowing limited rotational movement of the door in response to impact from a ballistic part when in the normally closed position. The sensor means detects the movement of the normally closed flap or door from the closed position, and signals actuation of a motor means to drive the normally closed flap or door from the closed position to an open position. Control means counts down a predetermined time period before reversing the motor means to return the normally closed flap or door from the open position to the closed position.

The motor means of the present invention can include a hydraulic or other fluid actuated piston actuator. The sensor means of the present invention can include mechanical switches or, in the preferred embodiment, a photoelectric light emitter and receiver for establishing a beam which can be broken by movement of the rotatable flap or door. In the alternative, the photoelectric means could be disposed within the enclosure to detect movement of a ballistic part within the enclosure.

Rotatable hinge and drive means can be provided for supporting the normally closed flap with respect to the enclosure housing. The rotatable hinge and drive means can include a shaft having a longitudinal axis of rotation. The rotatable shaft has at least one protrusion formed thereon engageable within an aperture formed in a sleeve disposed on said shaft for rotation about the longitudinal rotational axis. The sleeve forms a portion of the rotatable, normally closed flap or door. The aperture or slot formed within the sleeve portion of the rotatable flap allows limited rotational movement of the flap with respect to the rotatable shaft. The at least one protrusion connected to the shaft, in combination with the aperture formed in the sleeve portion of the flap, permits the flap to be driven from a closed position to an open position by rotation of the rotatable shaft by motor means connected to the shaft.

The use of a screw feeder for separating recyclable material from waste material is advantageous in that is eliminates the possibility of large metal pieces entering the crusher and possibly damaging the crusher. Further, the weight of the retractable cone prevents any recyclable material from discharging from the separator system.

The use of a crusher apparatus having an alternative exit for uncrushable material from the housing is advantageous in preventing extensive damage to the crushing machine. Further, the present invention eliminates the necessity of elaborate screening means to prevent non-crushable material from entering the crusher.

Other advantages and features of the present invention will become more apparent from reading the following detailed description in conjunction with the accompanying drawings.

BRIEF DESCRIPTION OF THE DRAWINGS

The present invention will be more fully understood by reference to the following detailed description of the preferred embodiment of the present invention when read in conjunction with the accompanying drawing, in which like reference characters refer to like parts through out the views; and in which.

DETAILED DESCRIPTION OF THE PREFERRED EMBODIMENT

Figure 1:
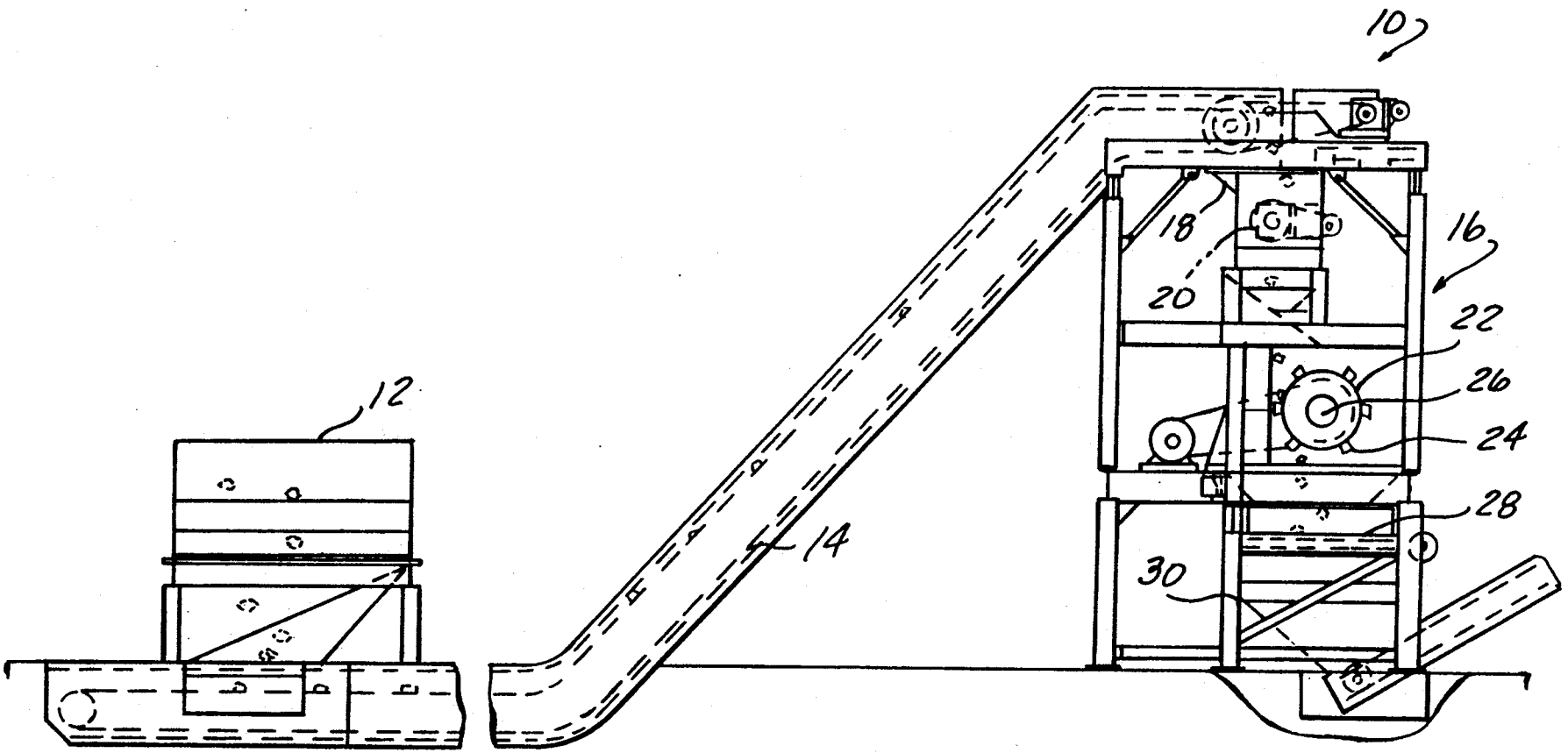
FIG. 1 is a front elevational view illustrating a material handling system having a material separator according to the present invention.

A material handling system for recycling material is shown in FIG. 1 and designated generally as 10. The system 10 includes a hopper 12 for storing the material to be recycled. The hopper 12 feeds into a conveyor 14 which transports the material from the hopper 12 to a material separator system generally shown at 16. The conveyor 14 fees the material to be recycled into an input chute 18 that directs the material into a screw feeder 20. This begins the process of material separation which will be described in greater detail below.

After separation, the recyclable material is directed into a crusher 22. The crusher 22 includes a series of hammers 24 which rotate about a central axis 26 to crush the recyclable material into small pieces. After the material is pulverized, it is gravity fed into a second hopper 30. The waste material separated from the recyclable material is discharged from the screw feeder 20 into a discharge chute 32. Chute 32 by-passes the crusher 22 and deposits the waste material on the vibrating grid 28. The waste material is removed from the top of the vibrating grid 28 and deposited into a waste bin.

Figure 2:
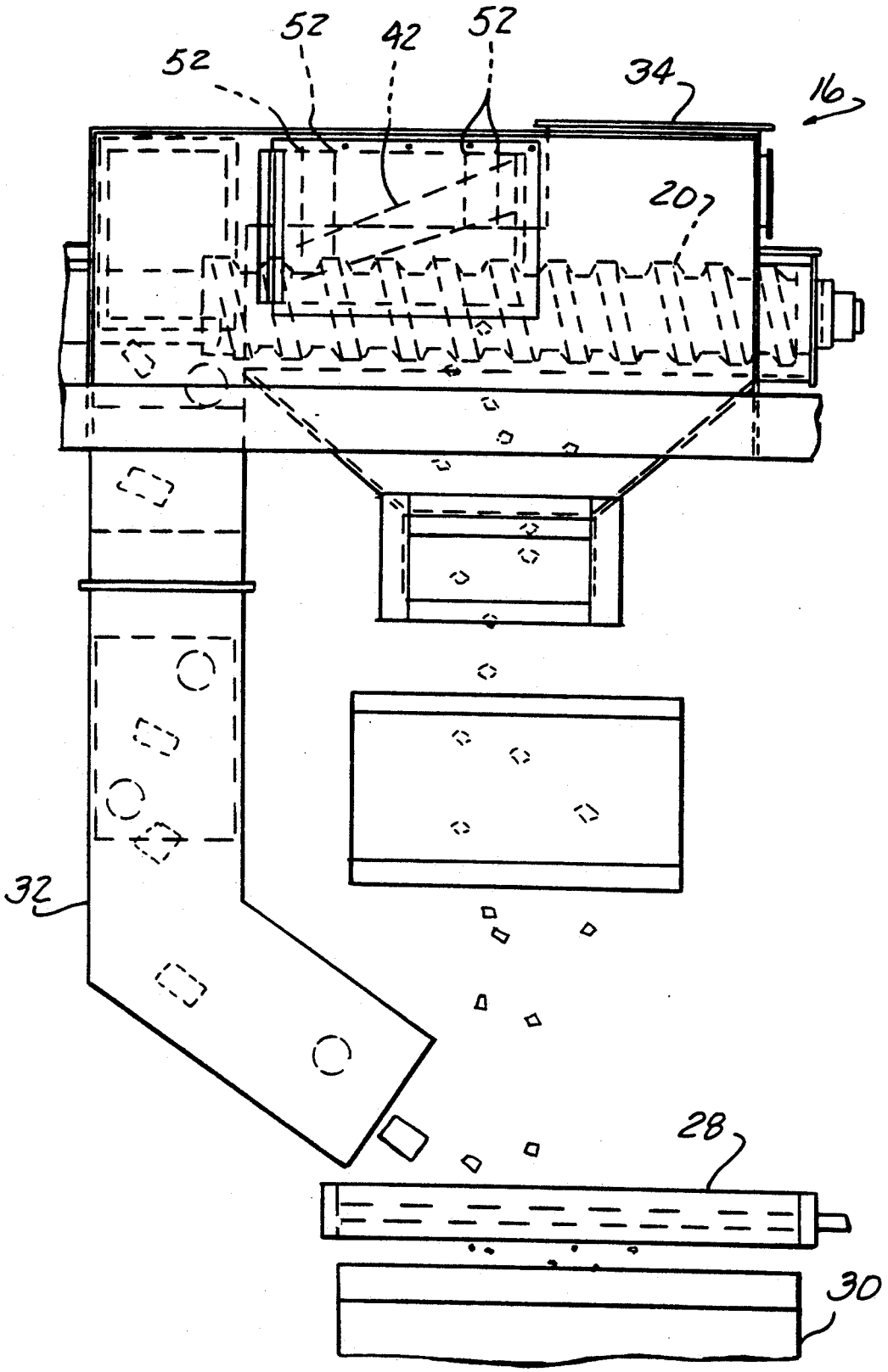
FIG. 2 is a side elevational view of the present invention.
Figure 3:
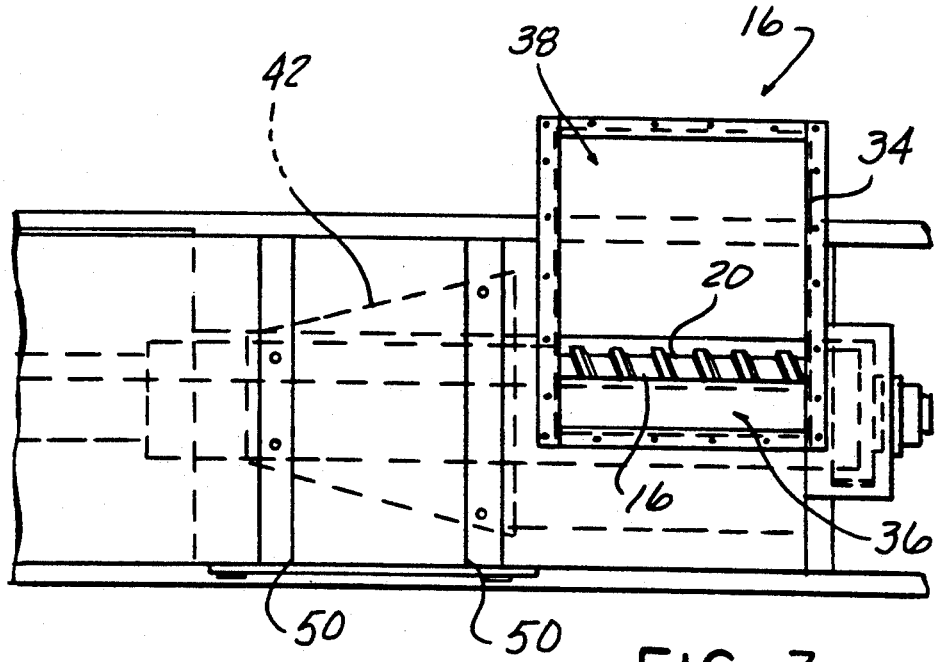
FIG. 3 is a top elevational view of the invention.
Figure 4:
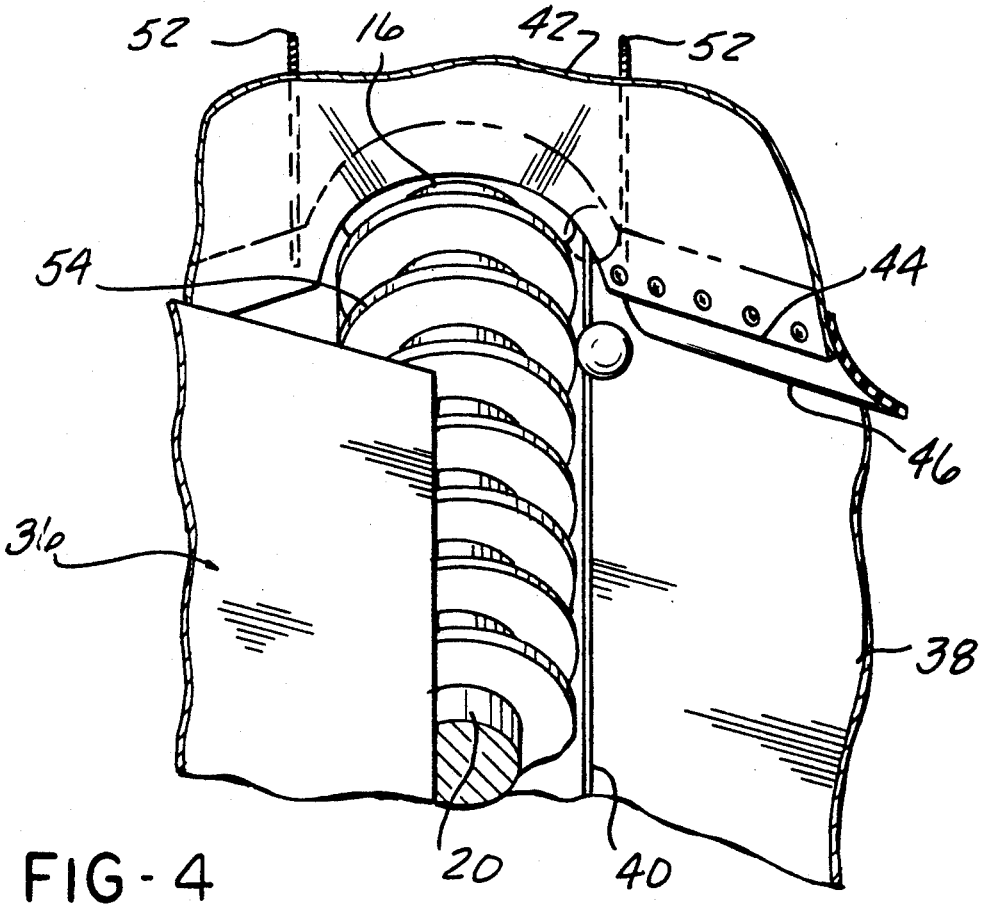
FIG. 4 is an end view of the invention.

The material separating system 16 is illustrated in FIGS. 2 and 3. The separating system 16 includes an inlet 34 for receiving the material from the conveyor 14. The inlet 34 extends above screw feeder 20 and deposits the material directly on the screw feeder 20. With reference now to FIGS. 2–4. A guide plate 36 extends angularly from the inlet 34 above the screw feeder 20. The guide plate 36 directs the material received from the conveyer 14 into the screw feeder 20 (FIG. 4). A feeder plate 38 extends from the inlet 34 downward toward the screw feeder 20 opposite the guide plate 36. The feeder plate 38 extends at an angle above the screw feeder 20 and creates a slot 40 that extends the entire length of the screw feeder 20 between the screw feeder 20 and the feeder plate 38. A retractable cone 42 hangs above the screw feeder 20 and rests one side 44 along the feeder plate 38. A flexible base 46 is provided along the edge of the retractable cone 42 for resting on the feeder plate. Retractable cone 42 is supported by a bracket 50 fixedly attached to the interior of the material separating system 16. Chains 52 extend from the bracket 50 to support the retractable cone 42 above the screw feeder 20. In this way, the retractable cone 42 hangs by its own weight above the screw feeder 20 while allowing the cone 42 to move with respect to bracket 50 by means of the chains 52. Screw feeder 20 includes a continuous screw section 54 extending the length of the material separating system. The screw section 54 has a variable central pitch 56 for varying the size of the material to be fed into the recycling slot 40. In the preferred embodiment, the central pitch is approximately two inches.

All material entering the separator is directed into the valley formed between the screw feeder and the feeder plate. Material small enough to pass through the opening formed by the circular pitch of the screw on two sides and the screw center pipe and the feeder plate on the other two sides falls directly to the crusher. Bushy recyclable material and large solid material conveys in the valley toward the retractable cone. As the bushy material conveys into the cone, it is compressed into the flights of the screw. The screw rotation is away from the feeder plate and as the bushy material is compressed it becomes entrained in the circular pitches causing it to ride over the top of the screw and to fall into the crusher feed opening which is on the opposite side of the screw from the feeder plate. The large solid material continues to convey into the cone causing it to retract and allow the solid to pass into the discharge chute opening and fall onto the vibrating grid. Any small recyclable material which may come out with the solid passes through the grid openings into the hopper under the crusher.

Figure 5:
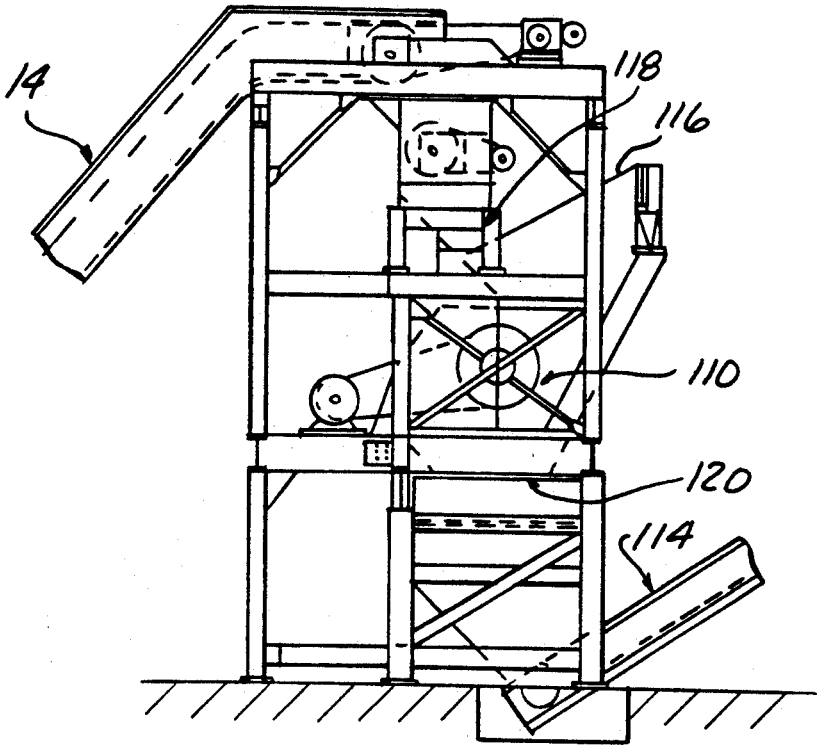
FIG. 5 is an elevational view of a crusher apparatus disposed in a process line.
Figure 8:
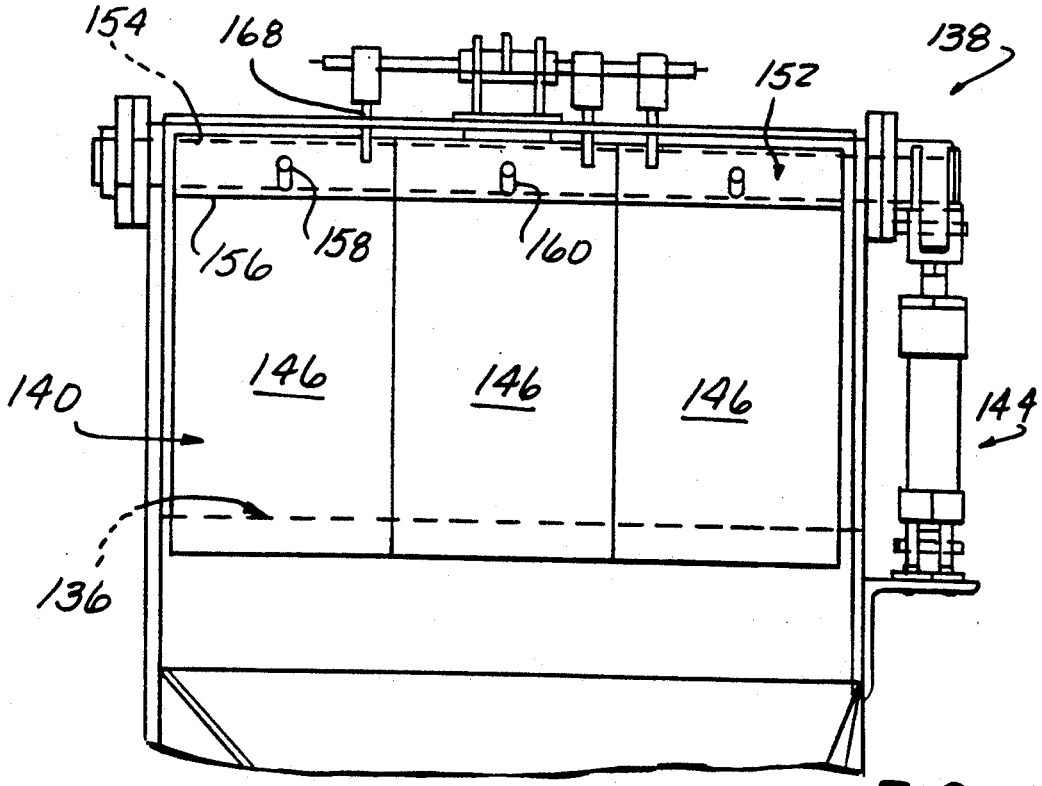
FIG. 8 is an end elevational view of the ballistic part ejector or bypass apparatus according to the present invention.
Figure 7:
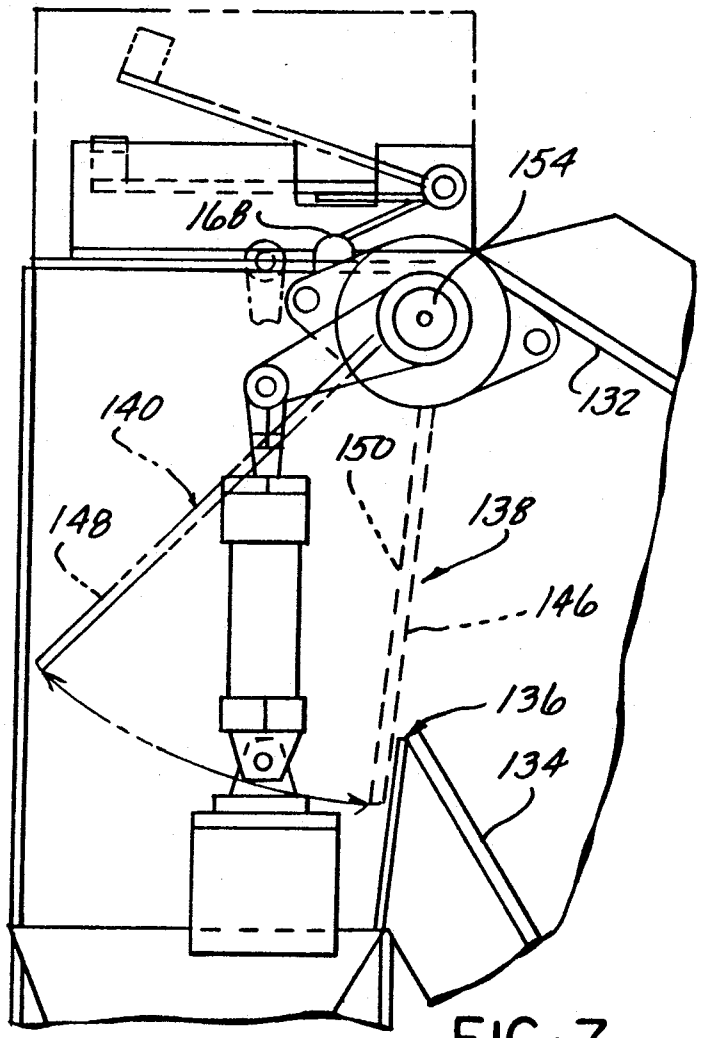
FIG. 7 is a detailed elevational view of the ballistic part ejector or bypass apparatus of the present invention.
Figure 6:
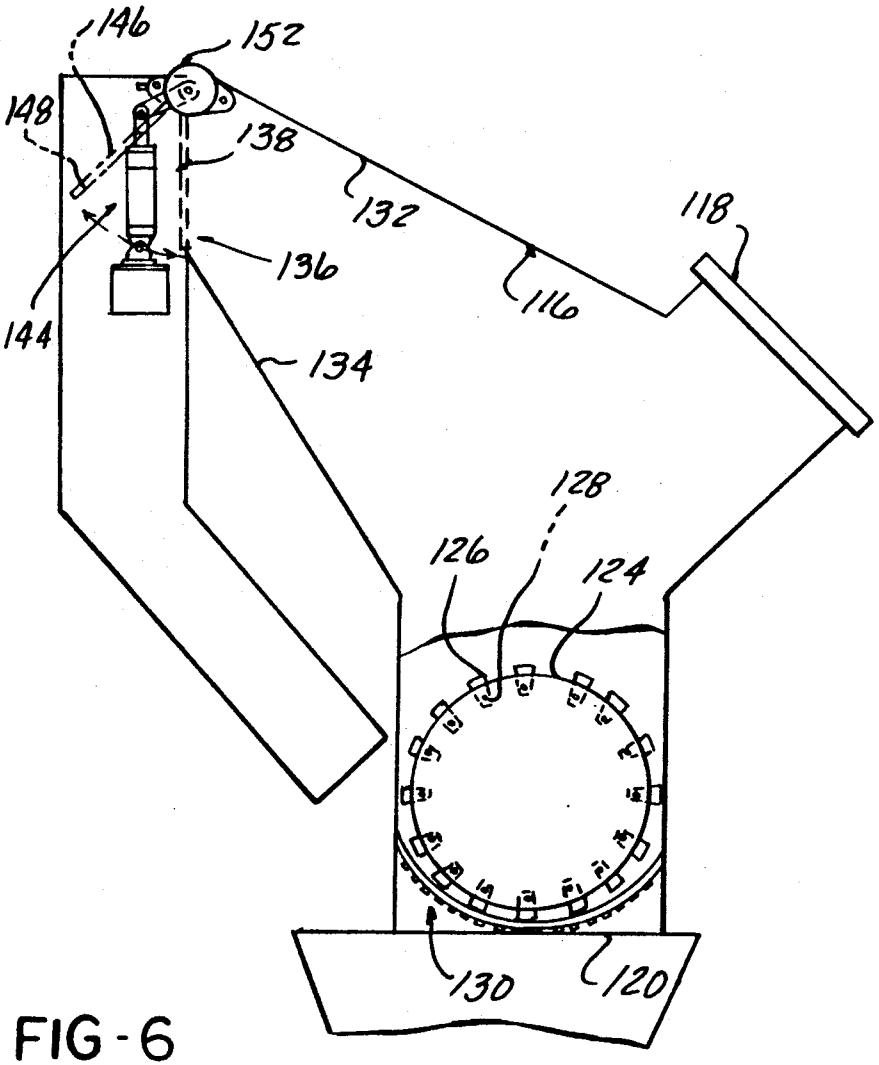
FIG. 6 is a more detailed schematic view of the crusher apparatus with various portions of FIG. 5 being removed for clarity.

A crusher apparatus, generally designated as 110, is shown in FIG. 5. The crusher apparatus 110 is shown in a processing line having conveyor 14 and a processed material removal means 114, as generally shown in FIG. 5. Referring now to FIG. 6, the crusher apparatus 110 generally includes a housing or enclosure 116 having a raw material inlet 118 and a processed material outlet 120. The processing of the material is generally accomplished by a rotary crusher 122 having at least one cylindrical portion 124 and at least one rotatable hammer arm 126 connected to the cylindrical portion 124 by pivot pins 128. The rotary crusher 122 operates in combination with a crusher grate 130 to ensure that the crushable material is processed to the desired size defined by the grate opening area size. These portions of the crusher apparatus 110 are typically well known and capable of taking various forms known to those skilled in the art. The present invention adapts the known configuration of the crusher apparatus 110 to accommodate the automatic egress of uncrushable material after it has entered the housing or enclosure 116.

The housing or enclosure includes first and second converging side walls, 132 and 134, respectively. The first and second converging side walls, 132 and 134, converge toward at least one aperture 136 in the housing 116. A closure means 138 is provided to selectively open and close the aperture 136 in response to uncrushable material within the enclosure 116. The closure means 138 acts as a ballistic part ejector or escape hatch. The convergent walls 132 and 134, along one portion of the enclosure 116, direct thrown or ballistic debris or material in a predetermined direction toward aperture 136. The closure means 138 is for operably obstructing the aperture 136 in the housing 116.

Closure 138, in its preferred form, may include door 140 operable between open and closed positions for selectively closing the ejector aperture 136 in the housing 116. Sensor means 142 is provided for sensing at least one ballistic part within the enclosure 116. Motor 144 is for moving the door 140 from the closed position to the open position for a predetermined period of time in response to activation of the sensor means 142. The sensor means 142 may sense movement of a ballistic uncrushable part within the enclosure 116, or in the preferred form, may be disposed for sensing contact of the ballistic part or thrown debris with the door 140.

In its preferred form, the door 140 may include at least one rotatable flap obstructing the ejector aperture 136 in the housing 116. The rotatable flap 146 is freely rotatable in response to impact by the ballistic uncrushable debris, while being operable by motor 144 for power driven rotation between an open position 148 and a normally closed position 150. The door 140 may also include, in its preferred form, a power driven hinge 152, for driving the rotatable flap 146 between open and closed positions, 148 and 150, respectively, while allowing free rotation of the rotatable flap 146 through a predetermined arc. This configuration of the closure means 138 can best be seen in FIGS. 9 and 10 of the attached drawings.

Figure 9:
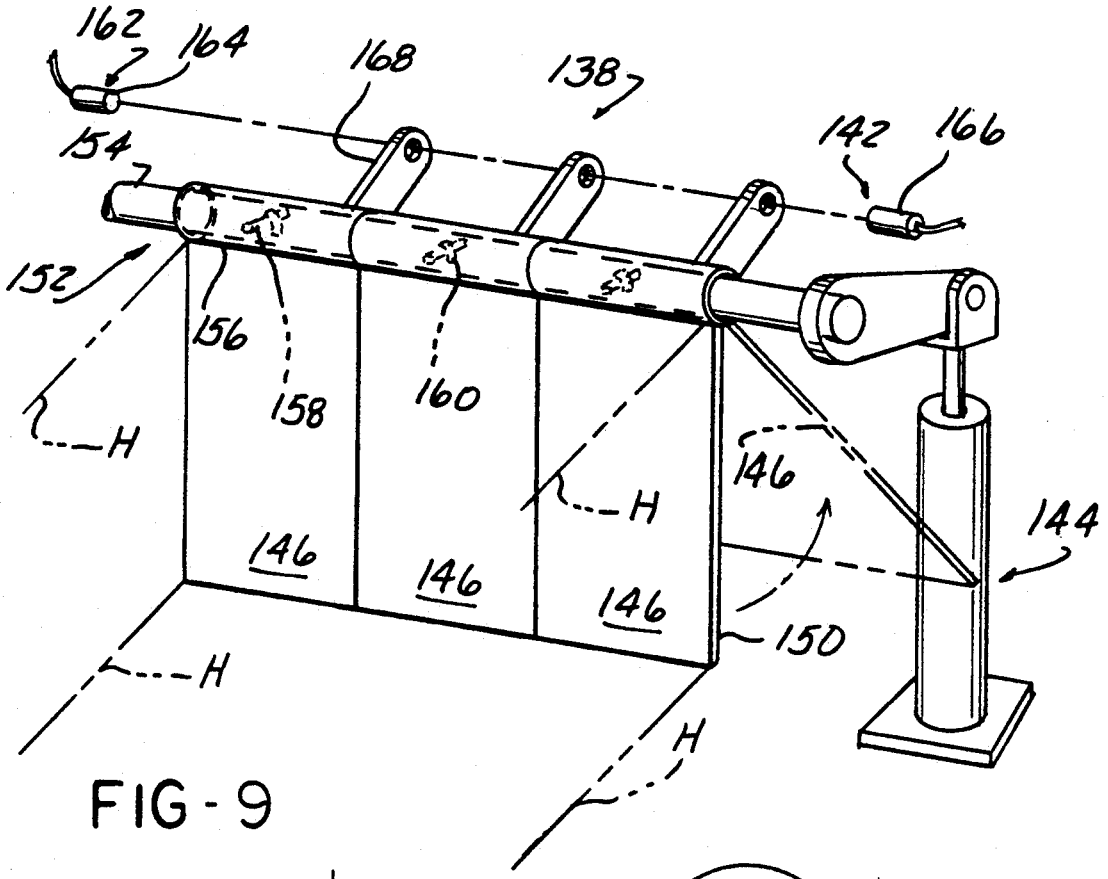
FIG. 9 is a simplified schematic perspective view of the ballistic part ejector or bypass apparatus according to the present invention.
Figure 10:
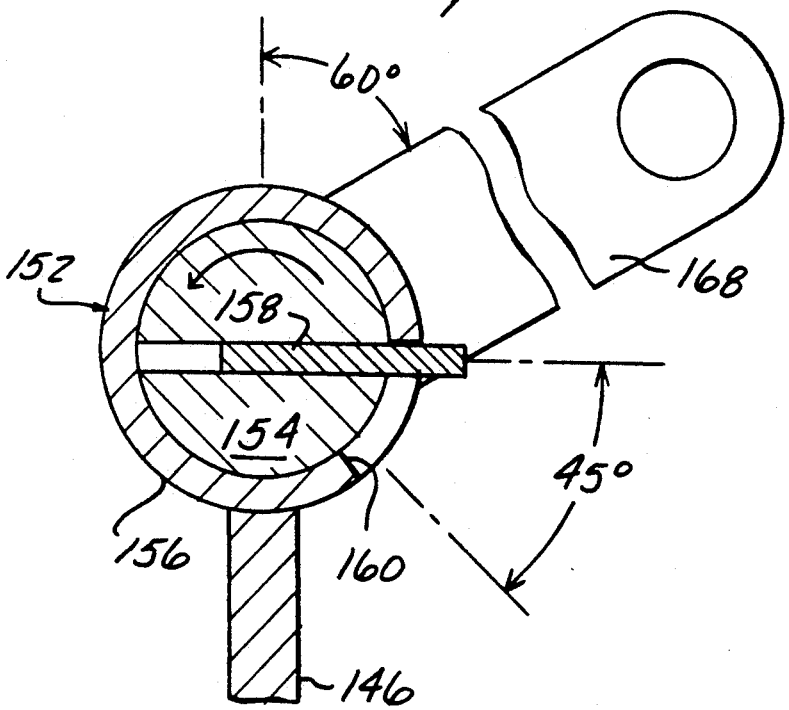
FIG. 10 is a detailed view of the hinged drive means according to the present invention.

The power driven hinge 152 can include a shaft 154 having a longitudinal axis of rotation. The rotatable flap 146 has a hinge portion 156 sheathing a portion of the shaft 154. Connected to the shaft 154 is a pin or protuberance 158 engaging within an elongated slot formed within the hinge portion 156 of the rotatable flap 146. The interaction between the pin 158 and slot 160 allows free rotation of the rotatable flap 146 through a predetermined arc of approximately 45° as shown in FIG. 9, while permitting power driven rotation of the rotatable flap 146, by rotation of shaft 154, to move the rotatable flap 146 from the normally closed position 150 to an open position 148 for a predetermined period of time.

In this preferred embodiment of the closure means 138, the sensor means 142 may take the form of photoelectric means for sensing free rotation of the at least one rotatable flap 146. The photoelectric means 162 may include a light emitter 164 and a light receiver 166 connected to control means for actuating the motor 144 in response to a disruption of the light beam passing from the emitter 164 to the receiver 166 by the protruding arm portion 168 of the rotatable flap 146. Of course, it should be recognized that the light emitter and receiver, 164 and 166, respectively, can be positioned in various locations to detect movement of the rotatable flap 146 without departing from the scope and spirit of the present invention. In addition, various control means can be provided for actuating the motor 144 used to rotate the shaft 154. The motor 144 can include various devices, such as a fluid, either gas or liquid, operated cylinder, electric motor or the like.

In operation, the present invention is capable of ejecting ballistic uncrushable parts by sensing at least one ballistic part within the housing with sensor means, moving a door covering an ejector aperture formed in the housing from a closed position to an open position allowing egress of the at least one ballistic part from the housing for a predetermined period of time in response to activation of the sensor means. The present method can also include the step of closing the door to cover the aperture in the housing after expiration of the predetermined period of time. The sensing step can include breaking a light beam to activate the sensor means. The sensing step can also include rotating the door freely about a hinge axis within a predefined arc in response to impact of at least one ballistic part with the door, and actuating the sensor means in response to free rotation of the door. The actuating step may include interrupting a photoelectric light beam as the door freely rotates through the predefined arc and activating the sensor means in response to interruption of the photoelectric light beam. The moving step may include rotating the door about a hinge axis within a predefined arc between a first normally closed position and a second open position with motor driven means. After the door has been held in the open position for a predetermined time period, the door is again returned to the normally closed position, and the sensor means is reset for subsequent reactivation.

It can be seen from the above described method and apparatus for separating materials that the size of the material to be recycled can be determined by the circular pitch of the screw feeder and the size of the slot feeding into the crusher. Further, the use of the screw feeder to simultaneously feed the waste material into the parts discharge chute while depositing the recyclable material into the crusher area eliminates excess steps necessary in previously known material separator assemblies. The use of the screw feeder to separate the materials also depletes the percentage of waste material discharged and disposed from the system. Furthermore, the implementation of a second exit in the crusher apparatus prevents serious damage to the crusher by uncrushable material received from the screw feeder. This second exit acts as a backup system to aid in redirecting uncrushable material from the material handling system.

Having described the present invention with respect to the illustrated embodiments depicting the best mode of operating the invention, however, many modifications thereto will become apparent to those skilled in the art to which it pertains without deviation from the spirit of the invention as defined by the scope of the appended claims.

We claim:

1. A material system comprising:

screw conveyor means for separating a generally continuous material stream into a crushable recyclable material stream and an uncrushable waste material stream, wherein the screw conveyor means includes:

an elongated screw conveyor having a longitudinal axis and an outer peripheral surface;

a feeder plate extending along the longitudinal axis of the screw conveyor for feeding the material stream into the screw conveyor from an inlet, the feeder plate having an edge spaced from the peripheral surface of the screw conveyor forming slot means defined by an aperture extending between the screw conveyor and the feeder plate for allowing materials small enough to pass through the aperture formed by the screw conveyor and the feeder plate to pass through the slot means forming the recyclable material stream, while uncrushable waste material conveys along the slot means in a predetermined longitudinally extending conveying direction in response to rotation of the screw conveyor; and retractable cone means supported radially outwardly from at least a portion of the screw conveyor adjacent a longitudinal end downstream from said inlet with respect to the predetermined longitudinally extending conveying direction, the retractable cone means for obstructing longitudinal passage of the recyclable material while allowing longitudinal passage of uncrushable waste material, the retractable cone means operable to move from an obstructing position to a retracted position with respect to the screw conveyor, the retractable cone means in said retracted position when moved in a radially outwardly direction away from the peripheral surface of the screw conveyor in response to engagement with uncrushable waste material, the uncrushable waste material being capable of passing by the retractable cone means when in the retracted position forming the uncrushable waste material stream.

2. The material handling system of claim 1 further comprising:

crusher means for receiving the crushable recyclable material stream for pulverizing and subsequent discharge into storage means.

3. The material handling system of claim 2 further comprising:

by-pass means for diverting uncrushable waste material around the crusher means.

4. The material handling system of claim 3, wherein the crusher means further comprises crusher means having a housing and a rotary crusher, and said by-pass means further comprising a ballistic part ejector including:

said housing having an ejector aperture formed therein;

door means operable between open and closed positions for selectively closing the ejector aperture in the housing;

sensor means for sensing contact of at least one ballistic part with said door means; and motor means, responsive to activation of said sensor means, for moving the door means from the closed position to the open position for a predetermined period of time.

5. The material handling system of claim 4 further comprising:

power driven hinge means for driving the door means in rotation between open and closed positions, while allowing free rotation of said door means through a predetermined arc.

6. The material handling system of claim 4 wherein said door means further comprises:

at least one rotatable flap obstructing said ejector aperture in said housing, said flap freely rotatable in response to impact by said at least one ballistic part.

7. The material handling system of claim 6 wherein said sensor means further comprises:

photoelectric means for sensing free rotation of said at least one rotatable flap.

8. The material handling system of claim 2 wherein said crusher means further comprises:

a crusher apparatus, said crusher apparatus having a housing and a rotary crusher means;

a ballistic part ejector for allowing uncrushable debris to be thrown out of the crusher apparatus, said ballistic part ejector including:

said housing having convergent walls along one portion to direct thrown debris in a predetermined direction toward at least one ejector aperture formed within said housing;

closure means for operably obstructing said at least one aperture in said housing;

sensor means for sensing ballistic debris within said housing; and power driven means, responsive to said sensor means, for opening said closure means for a predetermined period of time to allow said ballistic debris to exit said housing.

9. The material handling system of claim 8 wherein said sensor means senses contact of ballistic debris with said closure means.

10. The material handling system of claim 8 whereih said closure means further comprises:

at least one rotatable flap obstructing said at least one ejector aperture of said housing, said rotatable flap freely rotatable in response to impact by said ballistic debris.

11. The material handling system of claim 10 wherein said sensor means further comprises:

photoelectric means for sensing free rotation of said at least one rotatable flap.

12. The material handling system of claim 10 further comprising:

power driven hinge means for driving said closure means in rotation between open and closed positions, while allowing free rotation of said closure means through a predetermined arc.

13. The material handling system of claim 12 wherein said power driven hinge means further comprises:

a shaft having a longitudinal axis of rotation disposed adjacent said aperture in said housing;

a hinge portion of said closure means sheathing said shaft, said hinge portion having an elongated slot formed therein;

a pin protruding from said shaft and disposed within said elongated slot of said hinge portion, such that said closure means is freely rotatable through a predetermined arc defined by the length of said elongated slot, while permitting power driven rotation of said closure means through rotation of said shaft.

14. The material handling system of claim 1 wherein the screw conveyor means further comprises:

a screw conveyor having a variable circular pitch for varying a material size to be fed into the recyclable material stream.

15. A method for separating a material stream in a material handling system, the method comprising the steps of:

feeding the material stream into a screw conveyor; and separating the material stream into a crushable material stream and uncrushable waste material stream while moving with respect to the screw conveyor, the separating step further including the steps of:

rotating the screw conveyor about a longitudinal axis to feed the material stream along the screw conveyor from an inlet in a predetermined longitudinally extending conveying direction;

passing material small enough to fit through slot means defined by a peripheral surface of the screw conveyor and a feeder plate extending longitudinally along the screw conveyor to form the recyclable material stream, while uncrushable waste material conveys along the slot means in the predetermined longitudinally extending conveying direction;

obstructing passage of the recyclable material by retractable cone means supported radially outwardly from at least a portion of the screw conveyor adjacent a longitudinal end downstream from said inlet in the predetermined longitudinally extending conveying direction; and retracting the retractable cone means in response to engagement with uncrushable waste material to allow longitudinal passage of the uncrushable waste material to form the uncrushable waste material stream.

16. The method of claim 15, further comprising the step of:

conveying the material stream to the screw conveyor.

17. The method of claim 15, further comprising the step of:

depositing the crushable recyclable material stream into a crusher.

18. The method of claim 15 further comprising the step of:

bypassing the uncrushable waste material stream around a crusher.

19. The method of claim 18, further comprising the step of:

removing the waste material stream from said material handling system.

20. The method of claim 15 wherein said screw conveyor has a variable circular pitch for varying a size of material to be fed into a crusher.

21. A method for separating a material stream in a material handling system, the method comprising the steps of:

conveying the material stream into a screw conveyor;

rotating the screw conveyor about a central axis to feed the material stream along the screw conveyor;

feeding said material along said screw conveyor from an inlet in a predetermined longitudinally extending conveying direction;

separating the material stream into a crushable recyclable material stream and an uncrushable waste material stream while feeding along the screw conveyor, the separating step further including the steps of:

passing material small enough to fit through slot means defined by a peripheral surface of the screw conveyor and a feeder plate extending longitudinally along the screw conveyor to form the recyclable material stream, while uncrushable waste material conveys along the slot means in the predetermined longitudinally extending conveying direction;

obstructing passage of the recyclable material by retractable cone means supported radially outwardly from at least a portion of the screw conveyor adjacent a longitudinal end downstream from said inlet in the predetermined longitudinally extending conveying direction; and retracting the retractable cone means in response to engagement with uncrushable waste material to allow longitudinal passage of the uncrushable waste material to form the uncrushable waste material stream;

depositing the crushable recyclable material stream into a crusher;

bypassing the uncrushable waste material stream around the crusher; and removing the uncrushable waste material stream from the material handling system.

22. The method of claim 21, wherein said screw conveyor has a variable circular pitch for varying a size of the crushable recyclable material stream to be fed into the crusher.

* * * * *